US011208248B2

(12) United States Patent
Soriano et al.

(10) Patent No.: US 11,208,248 B2
(45) Date of Patent: Dec. 28, 2021

(54) CONTAINER FOR SMOKING ARTICLES

(71) Applicant: JT International S.A., Geneva (CH)

(72) Inventors: Miguel Soriano, Geneva (CH); Robert Alizon, Aubonne (CH); Jens Franzen, Hentern (DE)

(73) Assignee: JT International S.A.

( * ) Notice: Subject to any disclaimer, the term of this patent is extended or adjusted under 35 U.S.C. 154(b) by 38 days.

(21) Appl. No.: 16/499,653

(22) PCT Filed: Apr. 9, 2018

(86) PCT No.: PCT/EP2018/058972
§ 371 (c)(1),
(2) Date: Sep. 30, 2019

(87) PCT Pub. No.: WO2018/189075
PCT Pub. Date: Oct. 18, 2018

(65) Prior Publication Data

US 2020/0115145 A1 Apr. 16, 2020

(30) Foreign Application Priority Data

Apr. 10, 2017 (EP) ..... 17165824

(51) Int. Cl.
*B65D 75/58* (2006.01)
*B65D 85/10* (2006.01)

(52) U.S. Cl.
CPC ..... *B65D 75/5838* (2013.01); *B65D 75/5855* (2013.01); *B65D 85/1081* (2013.01);
(Continued)

(58) Field of Classification Search
CPC .. B65B 19/12; B65D 5/60; B65D 5/66; B65D 5/6602; B65D 75/58; B65D 75/5838;
(Continued)

(56) References Cited

U.S. PATENT DOCUMENTS 8,091,703 B2 * 1/2012 Marchetti ..... B65D 85/10568 206/268
10,053,273 B2 * 8/2018 Petrucci ..... B65D 85/1045
(Continued)

FOREIGN PATENT DOCUMENTS

WO 2008142540 A1 11/2008
WO 2014195008 A2 12/2014
(Continued)

OTHER PUBLICATIONS

Extended European Search Report for Application No. 17165824.8 dated Sep. 29, 2017,7 pages.
(Continued)

*Primary Examiner* — Bryon P Gehman
(74) *Attorney, Agent, or Firm* — Lerner, David, Littenberg, Krumholz & Mentlik, LLP

(57) ABSTRACT

A container for smoking articles has an outer housing including a hinged lid rotatable between open and closed positions. An inner package has an access opening through which smoking articles can be removed. The access opening can be covered by a reclosable flap when the hinged lid is in the closed position. With the lid in the closed position, the reclosable flap forms an overlap region with a surface of the inner package that extends around the periphery of the access opening. The overlap region includes a first adhering region to releasably affix the surface of the inner package and the reclosable flap, and a first non-adhering region. The first non-adhering region includes a portion of the periphery of the access opening.

15 Claims, 14 Drawing Sheets

(52) U.S. Cl.
CPC . *B65D 85/10484* (2020.05); *B65D 85/10568* (2020.05); *B65D 2543/00962* (2013.01)

(58) Field of Classification Search
CPC B65D 75/5855; B65D 85/10; B65D 85/1045; B65D 85/1081; B65D 2543/00962; B65D 85/10484; B65D 85/10568
USPC ..... 206/268
See application file for complete search history.

(56) References Cited

U.S. PATENT DOCUMENTS

| | | | | |
|---|---|---|---|---|
| 10,266,336 | B2 * | 4/2019 | Bray | B65B 19/12 |
| 10,377,548 | B2 * | 8/2019 | Bourgoin | B65D 75/5838 |
| 10,414,580 | B2 * | 9/2019 | Buse | B65D 85/10568 |
| 2005/0276525 | A1 | 12/2005 | Hebert et al. | |
| 2015/0034509 | A1 * | 2/2015 | Oliveira | B65D 85/1045 206/268 |

FOREIGN PATENT DOCUMENTS

| | | | | |
|---|---|---|---|---|
| WO | 2016087830 | A1 | 6/2016 | |
| WO | WO-2017108164 | A1 * | 6/2017 | B65D 85/10568 |

OTHER PUBLICATIONS

Inernational Search report including Written Opinion for Application No. PCT/EP2018/058972 dated Jun. 26, 2018, 10 pages.

* cited by examiner

CONTAINER FOR SMOKING ARTICLES

CROSS-REFERENCE TO RELATED APPLICATIONS

The present application is a national phase entry under 35 U.S.C. § 371 of International Application No. PCT/EP2018/058972, filed Apr. 9, 2018, published in English, which claims priority to European Patent Application No. 17165824.8 filed Apr. 10, 2017, the disclosures of which are incorporated herein by reference.

BACKGROUND OF THE INVENTION

The present invention relates to a container for consumer goods, in particular a container of smoking articles.

Some cigarette containers comprise a rigid outer housing and a sealed inner package within which cigarettes are contained, such as described in WO 2008/142540. Those containers have a resealable extraction opening in the inner sealed package that is selectively covered by a cover flap. The cover flap is connected to a hinged lid so that opening and closing the lid simultaneously opens and closes the cover flap over the resealable extraction opening. The cover flap is fixed to the inner package using an adhesive that extends about the whole of the extraction opening so that the cover flap can be detached from the inner package and fixed back again. This can allow the cover flap to seal cigarettes within the inner package when the lid is closed.

A number of problems arise in connection with known container designs. A first problem is that loose tobacco crumbs can become affixed to the adhesive, which can be unpleasant for users and can diminish the effectiveness of the adhesive. Another problem is that, under certain atmospheric conditions, the sealing provided by known cover flaps can actually be detrimental to the preservation of tobacco in smoking articles. An object of the present invention is to overcome and mitigate some of these problems.

BRIEF SUMMARY OF THE INVENTION

According to an aspect of the invention there is provided a container for consumer goods comprising: an outer housing comprising a hinged lid rotatable between open and closed positions; and an inner package of consumer goods within the outer housing comprising an access opening through which consumer goods can be removed, the access opening being covered by a reclosable flap; wherein, in the closed position, the reclosable flap forms an overlap region with a surface of the inner package that extends around the periphery of the access opening, the overlap region comprising a first adhering region to releasably affix the surface of the inner package and the reclosable flap, and a first non-adhering region, the first non-adhering region including a portion of the periphery of the access opening.

In this way, oxygen exchange is permitted between the external environment and the interior of the inner package, even when the reclosable flap is in the closed position. This is possible because the first non-adhering region, which includes a portion of the periphery of the access opening, is non-adhering. Therefore, the reclosable flap is generally not attached to the inner package in the non-adhering region. The reclosable flap and the inner package may be in contact or in close contact and there may be microscopic gaps between the two that can allow for fluid communication between the interior and exterior of the inner package. This can create a breathable seal, which can actually improve preservation of tobacco products in particular atmospheric conditions.

The first non-adhering region may preferably extend from an edge of the access opening to an exterior edge of the overlap region such that the fluid communication is provided for.

The non-adhering region may be neutralised to ensure that it does not adhere the inner package and the reclosable flap. For example, the overlap region may be initially provided with resealable adhesive in both the adhering and non-adhering regions, but the resealable adhesive in the non-adhering region may then be neutralised to remove the adhesiveness of the adhesive. For example, one surface of the overlap region may be provided with resealable adhesive in both the adhering and non-adhering regions and the other surface of the overlap region may be provided with a release agent in the non-adhering region such that the resealable adhesive does not adhere in the non-adhering region. In a preferred embodiment, the reclosable flap is provided with resealable adhesive in both the adhering and non-adhering regions and the surface of the inner package is provided with a release agent in the non-adhering region.

The release agent may be a silicone-based release agent. Preferably, the release agent is in the form of a printable composition, such as an ink.

The term "resealable adhesive" is used throughout the present specification to describe a generally low tack, removable adhesive capable of forming connection between two substrates such that the two substrates can be repeatedly separated and re-attached to one another.

As used herein, the terms "front", "back", "upper", "lower", "top", "bottom" and "side" refer to the relative positions of portions of containers according to the invention and components thereof when the container is in an upright position with the lid of the outer housing in the closed position and the hinge line at the back of the container. The access opening in the inner package is provided at an upper, front edge of the inner package so that it is exposed when the lid is in the open position.

The container may comprise means for attaching the reclosable flap to the hinged lid, preferably an inner surface of the hinged lid. In this way, opening the lid can simultaneously open the reclosable flap. Equally, closing the lid may simultaneously close the reclosable flap.

In a preferred embodiment, the means for attaching the reclosable flap to the hinged lid are provided so that an end of the reclosable flap can become attached to an inner surface of the hinged lid. The outer surface of the end of the reclosable flap may be connected to the inner surface of the hinged lid, so that the end of the reclosable flap remains flat and separate from the rest of the reclosable flap, thereby causing the reclosable flap to form an S-shaped bend when opening the hinged lid. Alternatively, the inner surface of the end of the reclosable flap may be connected to the inner surface of the hinged lid, so that the end of the reclosable flap folds onto the rest of the reclosable flap (e.g. by 180°), thereby causing the reclosable flap to form a U-shaped bend when opening the hinged lid.

The term "inner surface" is used throughout the specification to refer to the surface of a component of the assembled container that is facing towards the interior of the container, for example towards the consumer goods, when the container is in the closed position. The term "outer surface" is used throughout the specification to refer to the surface of a component of the container that is facing towards the exterior of the container when the container is in the closed position.

The reclosable flap may be attached to the hinged lid by permanent connections, for example, by a permanent adhesive. The term "permanent adhesive" is used throughout the present specification to refer to a generally high tack adhesive capable of forming a reliable and secure connection between two substrates such that the two substrates do not become substantially separated during the normal and intended use of the container. In fact, separation of two substrates affixed to one another by means of a permanent adhesive would typically cause some undesirable damage (e.g. tearing) to one or both substrates involved.

The reclosable flap may be attached to the lid by at least one activated adhesive element that is provided on a surface of the reclosable flap, on a surface of a lid, or on both. The bond between the reclosable flap and the lid is created by the consumer during use of the container and not during the manufacture of the container. This simplifies the manufacturing process as the burdensome step of connection of the reclosable flap to the hinged lid is eliminated.

In some embodiments, the at least one adhesive element is protected by a layer of backing material and the layer of backing material can be removed to expose and thereby activate the adhesive element. In other embodiments, the at least one adhesive element is activatable by the application of pressure or by the supply of moisture or heat. In these embodiments, the adhesive element may be protected, for example, covered by a layer of backing material, or unprotected.

The term "activatable" is used herein to describe an adhesive element that is supplied to the consumer in a non-tacky state, such that it is unable to stick to another component of the container. An activatable adhesive element requires some form of activation on the part of the consumer to be brought into a tacky state for application to another component.

The reclosable flap may be connected to the inner package so as to be movable relative to the inner package about a hinge line. In some embodiments, the reclosable flap may be attached to the outer surface of the inner package so that it covers the access opening in the inner package. In such case, the reclosable flap preferably extends beyond the periphery of the access opening.

In other embodiments, the reclosable flap is defined by a cut line or a line of weakness in the outer surface of the inner package that covers the access opening. In such case, an adhesive label may be adhered to the inner surface of the inner package in a portion where the reclosable flap overlies the adhesive label and the access opening may be provided in the adhesive label, for example, by a cut-out or a line of weakness, or a cut line, that defines a flap that covers the access opening.

The hinge line of the reclosable flap may be provided at a first side of the access opening, and the first non-adhering region may be provided at a second side of the access opening, preferably at an opposite side of the access opening. In this way, the non-adhering region is separated away from the hinge line. Thus, the non-adhering region may be provided at the end of the reclosable flap that is first peeled away from the inner package on opening. The absence of adhesion may be advantageous because it can improve the ease with which the container can be opened, especially when the container is opened for the first time, and particularly when the reclosable flap is attached to the hinged lid. In addition, this positioning of the non-adhering region can allow the user to grasp a free end of the reclosable flap without touching adhesive with their fingers.

In embodiments where the reclosable flap is connected to the hinged lid, the first non-adhering region may be provided adjacent the hinged lid with the lid in the closed position, the open position and all intermediate positions. The reclosable flap may include a connecting portion that connects a free end of the reclosable flap to the hinged lid, and the first non-adhering region may be provided at the connecting portion.

The first non-adhering region may be provided adjacent the hinge line. It has been found that tobacco crumbs preferentially gather at the pinch point between the reclosable flap and the inner package that is created by the hinge line. In some arrangements, tobacco crumbs may be guided towards the hinge line by the movement of the reclosable flap. By providing an adhesive-free region adjacent the hinge line, it is possible to reduce the number of tobacco crumbs that adhere to the reclosable flap. This can provide an additional advantage by allowing the reclosable flap to open more fully in order to improve access to the smoking articles in the inner package.

In some configurations, the first non-adhering region has a dimension, extending along the reclosable flap and away from the hinge line, that is at least around 4 mm, for example of at least around 6 mm, such as at least around 8 mm. It has been observed that the major portion of tobacco crumbs that adhere to prior art containers have an average size of less than around 3 mm. These containers sometimes present some tobacco crumbs with an average size of between around 3 mm and 5 mm. Isolated larger tobacco crumbs with an average size of up to around 1 mm are rarely visible as opening and closing the reclosable flap either rubs off the larger tobacco crumbs or breaks them into smaller particles. Therefore, by providing a first non-adhering region with a dimension of at least around 4 mm, accumulation of tobacco crumbs at the overlap region throughout container life is reduced as it is less likely that tobacco crumbs adhere at the overlap region and a portion of those that do adhere are broken into smaller particles throughout use of the container and transported towards the first non-adhering region, where they eventually fall off. Enlarging the first non-adhering region further reduces the accumulation of tobacco crumbs.

The dimension may be substantially perpendicular to the hinge line, along the reclosable flap. In some embodiments the dimension may be bent. This may occur when the hinge line is on a back wall of the inner package, and the second portion of the overlap region extends partially along the back wall and partially along the top wall.

The first non-adhering region may be provided in a strip that is substantially parallel to the hinge line. In another arrangement, a portion of the overlap region may be provided with a reduced adhesiveness and positioned at the other side of the access opening to the hinge line of the reclosable flap.

The hinge line may be provided at a top wall of the inner package. In other arrangements, the hinge line may be provided at a back wall of the inner package, adjacent the hinged lid. The reclosable flap may be connected to the inner package at the top wall and/or the back wall.

The inner package may have a top wall and a front wall, and the first adhering region may be provided at least partially at the top wall and at least partially at the front wall. It has been found advantageous to provide resealable adhesive on the top wall and the front wall because it can help to position the reclosable flap in the desired position when closed. In a closing operation, adhesion may occur first on the top wall, which can help the reclosable flap to wrap around the upper, front edge and adhere against the front wall. This is particularly advantageous in embodiments where the reclosable flap is connected to the hinged lid.

The adhering region may have a length, extending along the package and away from the front wall along the top wall, which is at least around 4 mm, such as at least around 6 mm, for example of at least around 8 mm. In some embodiments, the adhering region has a length of at least around 12 mm.

The first adhering region may have a length at the top wall that is at least around 25% of the depth of the top wall of the inner package. In another arrangement, the first portion of the coupling region may have a length at the top wall that is at least around 25% of the distance between the front, upper edge and the hinge line of the reclosable flap.

The overlap region may comprise a second non-adhering region, wherein the first adhering region is between the first and second non-adhering regions. The second non-adhering region may optionally include a portion of the periphery of the access opening. For example, the hinge line of the reclosable flap may be provided at a first side of the access opening, the first non-adhering region may be adjacent the hinge line, the second non-adhering region may be provided at a second, opposite side of the access opening.

The overlap region may comprise a plurality of adhering regions and a plurality of non-adhering regions, where the adhering regions are intercalated between the non-adhering regions. Preferably, the adhering and non-adhering regions are provided as strips, which are preferably substantially parallel to the hinge line.

According to another aspect of the invention there is provided a method of manufacturing a container for consumer goods, comprising the steps of: providing an outer housing comprising a hinged lid rotatable between open and closed positions; providing an inner package of consumer goods within the outer housing, wherein the inner package comprises an access opening through which consumer goods can be removed; providing a reclosable flap to cover the access opening of the inner package, wherein, in the closed position, the reclosable flap forms an overlap region with a surface of the inner package that extends around the periphery of the access opening; providing a first adhering region in the overlap region to releasably affix the surface of the inner package and the reclosable flap; and providing a first non-adhering region, the first non-adhering region including a portion of the periphery of the access opening.

The adhering region may be provided in the overlap region by providing a resealable adhesive thereat. The non-adhering region may be provided in the overlap region by providing a region substantially free of adhesive. For example, the non-adhering region may be initially provided with resealable adhesive in both the adhering and non-adhering regions, but the resealable adhesive in the non-adhering region may then be neutralised to remove the adhesiveness of the adhesive. In other examples, one surface of the overlap region may be provided with resealable adhesive in both the adhering and non-adhering regions and the other surface of the overlap region may be provided with a release agent in the non-adhering region such that the resealable adhesive does not adhere in the non-adhering region. In a preferred embodiment of this example, the reclosable flap is provided with resealable adhesive in both the adhering and non-adhering regions and the surface of the inner package is provided with a release agent in the non-adhering region.

The method may involve positioning the reclosable flap on the inner package with respect to the access opening such that the non-adhering region includes a pre-defined portion of the periphery of the access opening. This may be achieved by referencing the first non-adhering region of the overlap region against the access opening. This can ensure that the reclosable flap is positioned correctly so that it can seal the contents of the inner package effectively.

In some embodiments, the pre-defined portion of the periphery of the access opening may be adjacent the reclosable flap hinge line. In other embodiments, the hinge line of the reclosable flap may be provided at a first side of the access opening and the pre-defined portion of the periphery of the access opening may be provided at a second side of the access opening, for example at an opposite side of the access opening.

BRIEF DESCRIPTION OF THE DRAWINGS

Embodiments of the invention are now described, by way of example, with reference to the drawings, in which.

DETAILED DESCRIPTION

Figure 1:
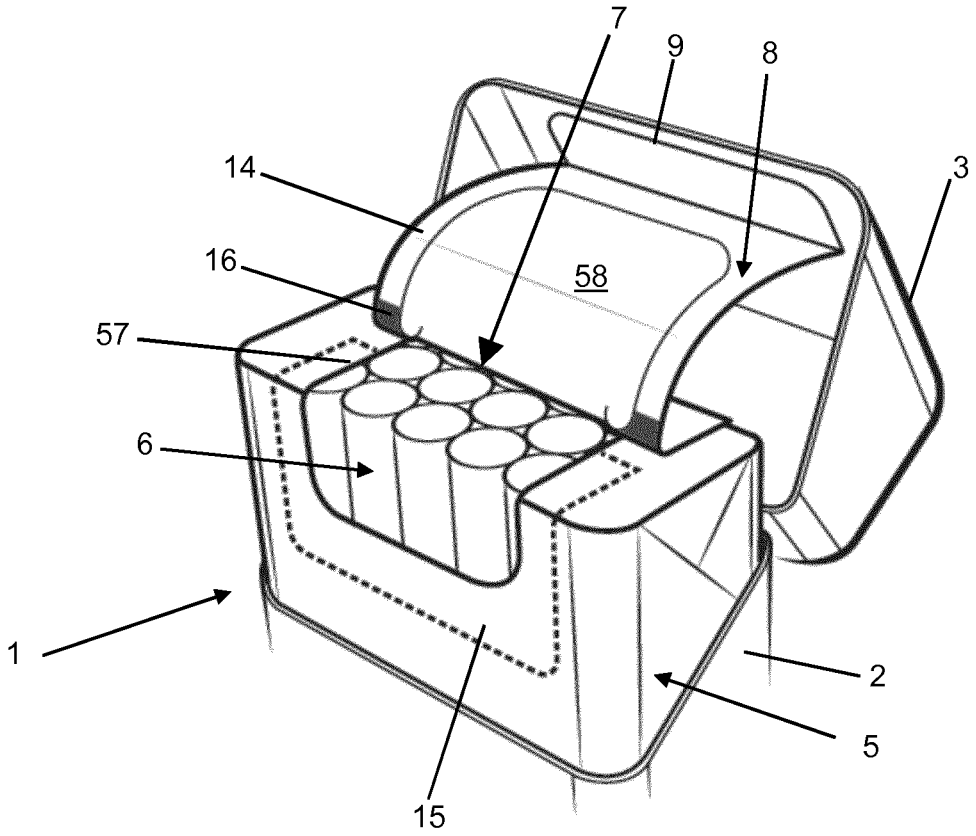
FIG. 1 is a perspective view of an upper part of a container in a first embodiment of the invention.

The hinged lid container 1 shown in FIG. 1 comprises a box 2 and a lid 3 that is hinged to the box 2 along a hinge line. FIG. 1 shows the container 1 with the lid 3 in an open position. A bundle of cigarettes, wrapped in an inner package 5, is housed in the box 2 of the container 1.

The box 2 has a box front wall, a box left side wall, a box right side wall, a box back wall, and a box bottom wall. The upper side of the box 2 is open, to provide an upper opening through which the cigarettes can be removed.

The lid 3 has a lid front wall, a lid left side wall, a lid right side wall, a lid back wall and a lid top wall. When the container 1 is closed, the free edges of the walls of the lid 3 abut the free edges of the walls of the box 2 along a line of abutment. In the closed position, the walls of the lid 3 therefore form extensions of the corresponding walls of the box 2 to define the walls of the outer housing 1.

The inner package 5 includes an access opening 6 through which the cigarettes can be removed. When the inner package 5 of cigarettes is in place within the box 2, the access opening 6 is positioned at the open, upper end of the box 2. The access opening 6 includes a cut line 57 that defines a flap 58 that covers the access opening 6. The flap 58 is movable to cover and uncover the access opening 6 and thus prevent or allow access to the cigarettes. A line of weakness may be provided instead of the cut line 57 so that the flap 58 separates from the inner package 5 only upon first opening of the container 1. Alternatively, the access opening 6 is a cut-out 59 (see FIG. 16B).

An inner frame 4 (formed from a blank 40 shown in FIG. 17) is mounted within the inner package 5 of the container 1. The inner frame 4 comprises an inner frame front wall, an inner frame left side wall and an inner frame right side wall which are positioned proximate the inner surface of the inner package front wall, inner package left side wall and inner package right side wall, respectively. The inner frame 4 may be optionally connected, for example, glued, to the inner package 5. The inner frame front wall includes a rectangular cut-out at the top free edge, in order to facilitate removal of the cigarettes from the box 2. The rectangular cut-out substantially corresponds to a front wall portion of the access opening 6 in the inner package 5. The walls of the inner frame 4 extend above the upper edges of the box 2.

A reclosable flap 8 is attached to the outer surface of the inner package 5 so that it can cover the access opening 6 in the inner package 5. The reclosable flap 8 is affixed to the inner package 5 at an upper, back edge of the inner package 5, which provides a hinge line 7 about which the reclosable flap 8 can be pivoted to open and close the access opening 6. The reclosable flap 8 extends beyond the periphery of the access opening 6 and is also affixed to the inner package flap 58.

The reclosable flap 8 in this embodiment is a self-adhesive label. The label 8 includes a resealable adhesive on its inner surface, which overlies a portion of the inner package 5 around the periphery of the access opening 6. When the lid 3 is in the closed position, the resealable adhesive affixes the adhesive label 8 to the inner package 5.

The resealable adhesive may also be used to affix the reclosable flap 8 to the inner package flap 58, although it is preferred to use a permanent adhesive to prevent the inner package flap 58 from peeling off the label 8 after a number of openings. The resealable adhesive may be a pressure sensitive adhesive. The permanent adhesive may be a UV-cured pressure sensitive adhesive.

Figure 2:
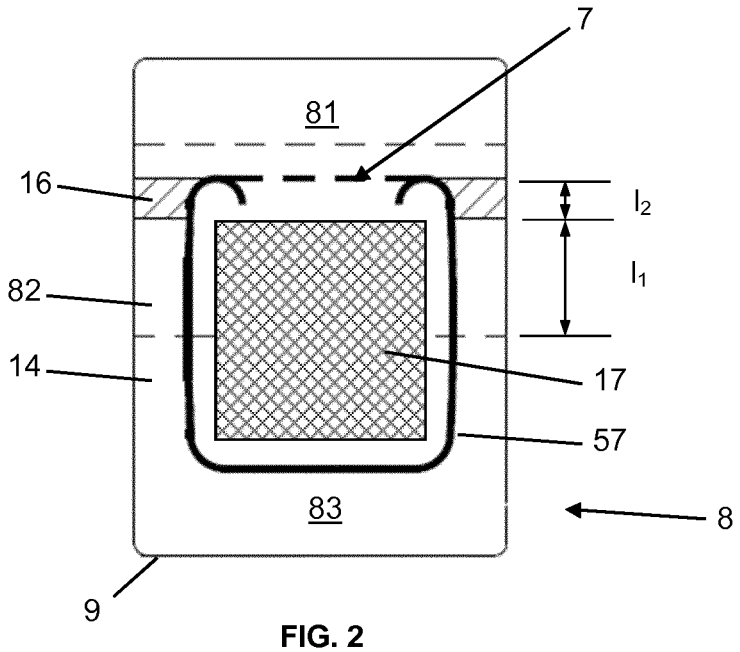
FIG. 2 is a plan view of a reclosable flap of the container in the first embodiment of the invention.

The permanent adhesive may be provided inside a frame of resealable adhesive within the periphery 57 of the access opening 6, as shown in FIG. 2, where the permanent adhesive is provided in an area 17 within the periphery 57 of the access opening 6. The frame may have a minimum separation with the periphery 57 of the access opening 6 of about 1 to 5 mm, for example of about 2 to 3 mm. By providing a frame of resealable adhesive around the permanent adhesive area 17 inside the periphery 57 of the access opening 6, it is possible to mitigate the inner package flap 58 from peeling off the label 8 after a number of openings while absorbing label 8 positioning tolerances over the inner package flap 58 that could cause the label 8 to permanently adhere to the inner package 5 inside and outside the access opening 6, thus, preventing opening the inner package 5 without damaging it. Although only represented in this embodiment, the permanent adhesive area 17 may be optionally present in any embodiment having an inner package flap 58.

In an alternative embodiment where the access opening 6 is a cut-out 59, the label 8 is substantially free of adhesive within the periphery 57 of the access opening 6.

As shown in FIG. 1, the reclosable flap 8 is attached at one end to the inner package 5 and at the other end to an inner surface of the hinged lid 3. An outer surface of the label 8 is permanently affixed at its free end 9 to the inner surface of the hinged lid 3, for example with a permanent adhesive provided in fluid state onto the label 8 and/or the inner surface of the lid 3 (e.g. spots of hot melt adhesive) or on a carrier material (e.g. a double-sided adhesive tape). As a result, movement of the lid 3 causes movement of the label 8. When the free end 9 of the label 8 is connected to the hinged lid 3, the free end 9 constitutes a connecting portion of the label 8.

The inner surface of the reclosable flap 8 includes an overlap region where, with the lid 3 in the closed position, the reclosable flap 8 is provided next to the inner package 5, around the periphery 57 of the access opening 6. The inner surface of the reclosable flap 8 includes a first portion 14 having a resealable adhesive to releasably affix the inner package 5 and the reclosable flap 8 and a second portion 16, which is substantially free of adhesive. In this embodiment the second portion 18 of the overlap region is provided adjacent the hinge line 7 of the reclosable flap 8 on the top wall of the inner package 5. In the closed position, the first portion 14 of the reclosable flap 8 is provided next to a sealing portion 15 of the inner package 5 so that the respective walls adhere. Of course, in another embodiment the resealable adhesive may be provided on the sealing portion 15 of the inner package 5, rather than the reclosable flap 8. In the closed position, the second portion 16 of the reclosable flap 8 is provided next to a corresponding portion of the inner package 5 on the periphery 57 of the access opening 6, but no adhesion occurs between the two surfaces. The respective surfaces may lie very close together, or be in direct contact, but the absence of sealing engagement means that fluid exchange may be possible between the interior of the inner package 5 and the external environment. This creates a breathable seal for the access opening 6, which can help to preserve the tobacco in the cigarettes under certain atmospheric conditions.

In this embodiment the second portion 16 of the reclosable flap 8, which is substantially free of adhesive, is provided adjacent the hinge line 7. It has been found that tobacco crumbs preferentially gather at hinge line 7, and an absence of adhesive in this region means that it is possible to reduce the number of tobacco crumbs that are visible in normal use.

By providing the second portion 16 of the reclosable flap 8 adjacent the hinge line 7 it is also possible to reduce adhesion that might otherwise prevent or restrict the reclosable flap 8 from opening fully in the lid open position. This arrangement may advantageously improve access to the cigarettes in the inner package 5.

FIG. 1 illustrates the second portion 16 extending from the edge 57 of the access opening 6 when in the closed position to the exterior of the reclosable flap 8 such that a breathable area is defined. This area together may be considered to be a non-adhering region of the overlap region of the container 1. For example, in combination, the reclosable flap 8 and the inner package 5 together overlap, the second portion 16 defining an area of non-adherence when combined with the corresponding portion of the inner package 5. Optionally, this area extends from the inner edge of the overlap region to the exterior edge such that the non-adhering region creates a break in the seal surrounding the access opening 6 to provide a breathable seal for the access opening 6 of the inner package 5.

FIG. 2 is a plan view of the inner surface of the reclosable flap 8 used in the container 1 represented in FIG. 1. The periphery 57 of the access opening 6 has been represented for ease of reference but is not a part of the reclosable flap 8. The hinge line 7 is also represented in dotted line. Similarly, transverse dotted lines represent the relative position of the upper, front and upper, back edges of the inner package 5 when the reclosable flap 8 is over the inner package 5 in the closed position.

As can be seen in FIG. 2, the reclosable flap 8 includes a back surface 81, a top surface 82 and a front surface 83 when the lid 3 is in the closed position. These are the positions of the relevant surfaces 81, 82, 83 of the reclosable flap 8 on the rectangular cuboid that is the inner package 5. The second portion 16 of the reclosable flap 8, which is substantially free of resealable adhesive, has a length $l_2$ of around 4.5 mm, extending from the hinge line 7, in a direction substantially perpendicular to the hinge line 7, along the top surface 82.

It has been found advantageous to provide resealable adhesive on the first portion 14 of the reclosable flap 8 on at least the top surface 82 and the front surface 83. This can allow the reclosable flap 8 to wrap around the top, front edge of the inner package 5 in a reliable way, which can help to ensure that the reclosable flap 8 is positioned correctly when the lid 3 is moved from the open to the closed position. In this embodiment, the first portion 14 of the reclosable flap 8 has a length $l_1$ of around 14 mm, extending toward the hinge line 7, in a direction substantially perpendicular to the hinge line 7, along the top surface 82.

In another embodiment, not shown, the first portion 14 of the reclosable flap 8 has a length $l_1$ of around 9 mm, extending toward the hinge line 7, in a direction substantially perpendicular to the hinge line 7, along the top surface 82. In this same embodiment, the second portion 16 of the reclosable flap 8, which is substantially free of resealable adhesive, has a length $l_2$ of around 9 mm, extending from the hinge line 7, in a direction substantially perpendicular to the hinge line 7, along the top surface 82.

Thus, the resealable adhesive extends about the lower edge of the periphery 57 of the access opening 6, about the left and right edges of the periphery 57 of the access opening 6 in the front wall of the inner package 5 and about a portion of the left and right edges of the periphery 57 of the access opening 6 in the top wall of the inner package 5.

The outer surface of the free end 9 of the reclosable flap 8 is provided with a permanent adhesive (not shown) for attachment to the inner surface of the lid 3.

In another embodiment, not shown, the inner package 5 may be provided with a release agent such that when a reclosable flap 8, substantially comprising an adhesive layer, overlies the inner package 5, the reclosable flap 8 will not adhere to the inner package 5 in that region.

Figure 3:
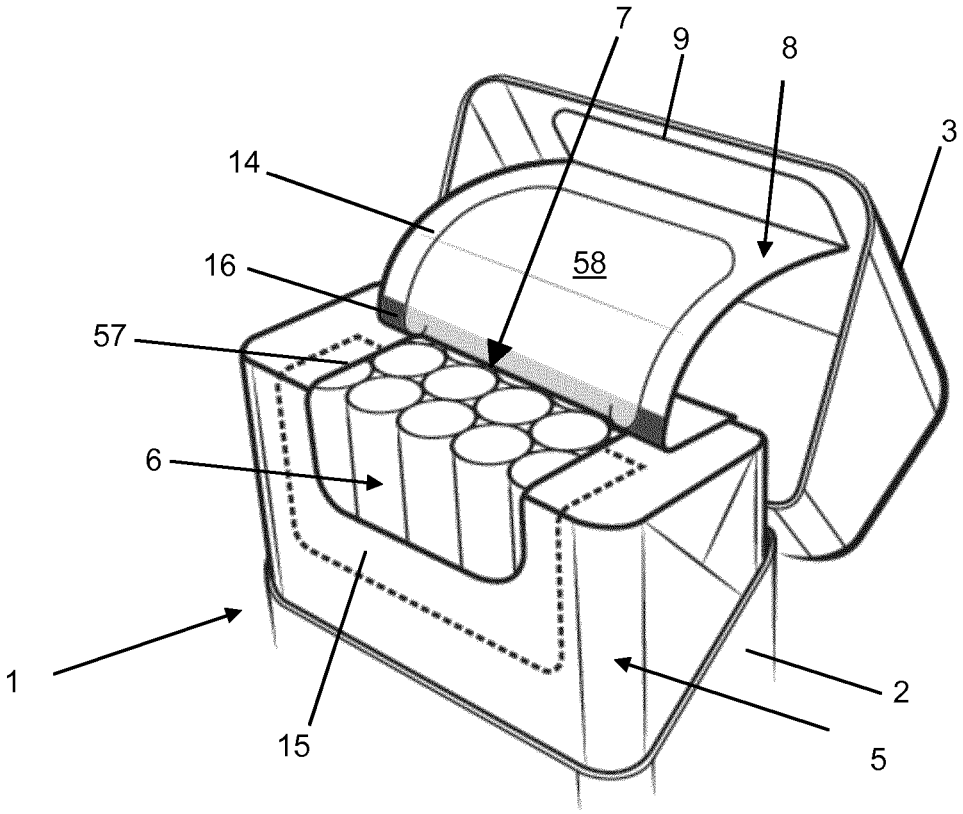
FIG. 3 is a perspective view of an upper part of a container in a second embodiment of the invention.
Figure 4:
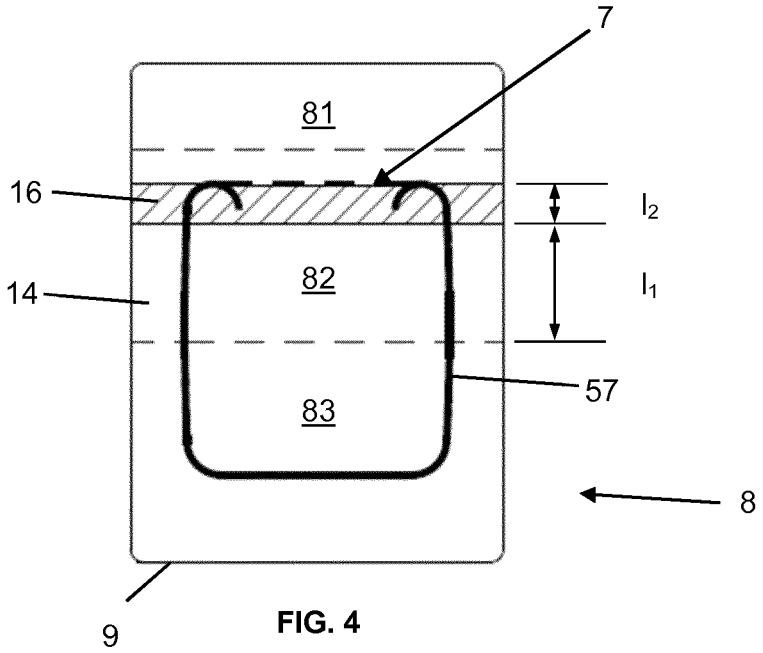
FIG. 4 is a plan view of a reclosable flap of the container in the second embodiment of the invention.

FIG. 3 is a perspective view of an upper part of a container 1 in a second embodiment of the invention, and FIG. 4 is a plan view of the reclosable flap 8. For the sake of brevity, only differing features to those of the embodiment represented in FIGS. 1 and 2 will be discussed below. In this arrangement, the second portion 16 of the reclosable flap 8 extends across the full width of the flap 8. The central section of the second portion 16 of the reclosable flap 8 lies behind the flap 58 of the inner package 5, in use. Thus, only the ends of the second portion 16 that project either side of the inner package flap 58 are exposed in normal use.

Figure 5:
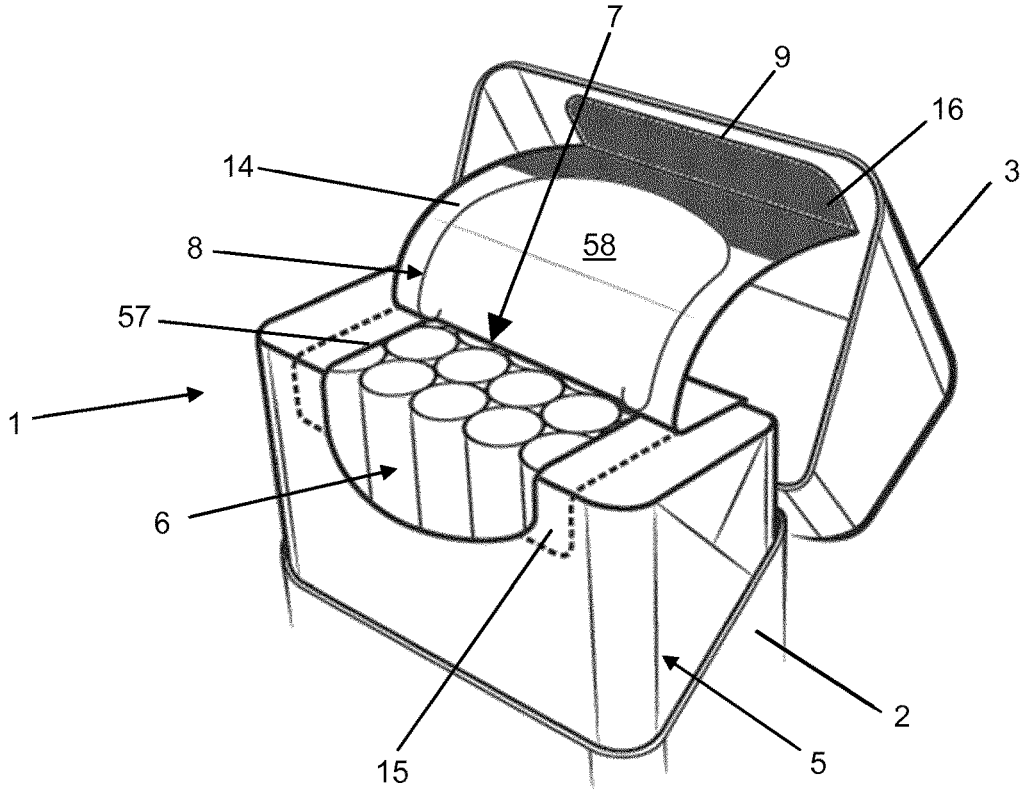
FIG. 5 is a perspective view of an upper part of a container in a third embodiment of the invention.

FIG. 5 is a perspective view of an upper part of a container 1 in a third embodiment of the invention. In this arrangement, the second portion 16 of the reclosable flap 8, which is substantially free of resealable adhesive, is provided adjacent the hinged lid 3, at the free end 9 of the label 8, and around part of the periphery 57 of the access opening 6. The first portion 14 of the reclosable flap 8, which is provided with resealable adhesive, extends from the second portion 16 to the hinge line 7. As can be appreciated in FIG. 5, the resealable adhesive extends about the left and side edges of the periphery 57 of the access opening 6 in the top wall of the inner package 5, about a portion of the left and side edges of the periphery 57 of the access opening 6 in the front wall of the inner package 5, but does not extend about the lower periphery 57 of the access opening 6.

In the closed position of the lid 3, the second portion 16 of the reclosable flap 8, which is substantially free of adhesive, is next to the inner package 5 by the periphery 57 of the access opening 6. The absence of a sealing engagement in this region means that a breathable seal is created, which can allow oxygen exchange between the interior of the inner package 5 and the external environment. A further advantage is created because the absence of any resealable adhesive at the connecting portion 9 of the label 8 to the lid 3 improves the ease with which the container 1 can be opened. During a normal opening operation, the hinged lid 3 pulls the reclosable flap 8 away from the inner package 5 such that they peel apart, where they have adhered. During opening, the second portion 16 of the reclosable flap 8 moves easily away from the inner package 5 since it is not adhered. This eases initial opening of the hinged lid 3, and improves the ease with which the first portion 14 can be peeled away, once this peeling process has begun.

The access opening 6 has a curved lower periphery 57 in this embodiment, which corresponds with a curved surface in the second portion 16 of the reclosable flap 8. It has been found that this shape of access opening 6 can improve the ease with which users access the cigarettes 11. Although only represented in this embodiment, the curved shape of the access opening 6 in the lower periphery 57 can be implemented in any other embodiment of the invention.

In an alternative embodiment, not shown, the second portion 16 of the reclosable flap 8 may extend across the full width of the flap 8. Therefore, the central section of the second portion 16 of the reclosable flap 8 may lie behind the inner package flap 58, in use. Thus, only the section of the second portion 16 that projects outside of the inner package flap 58 is exposed in normal use.

Figure 6:
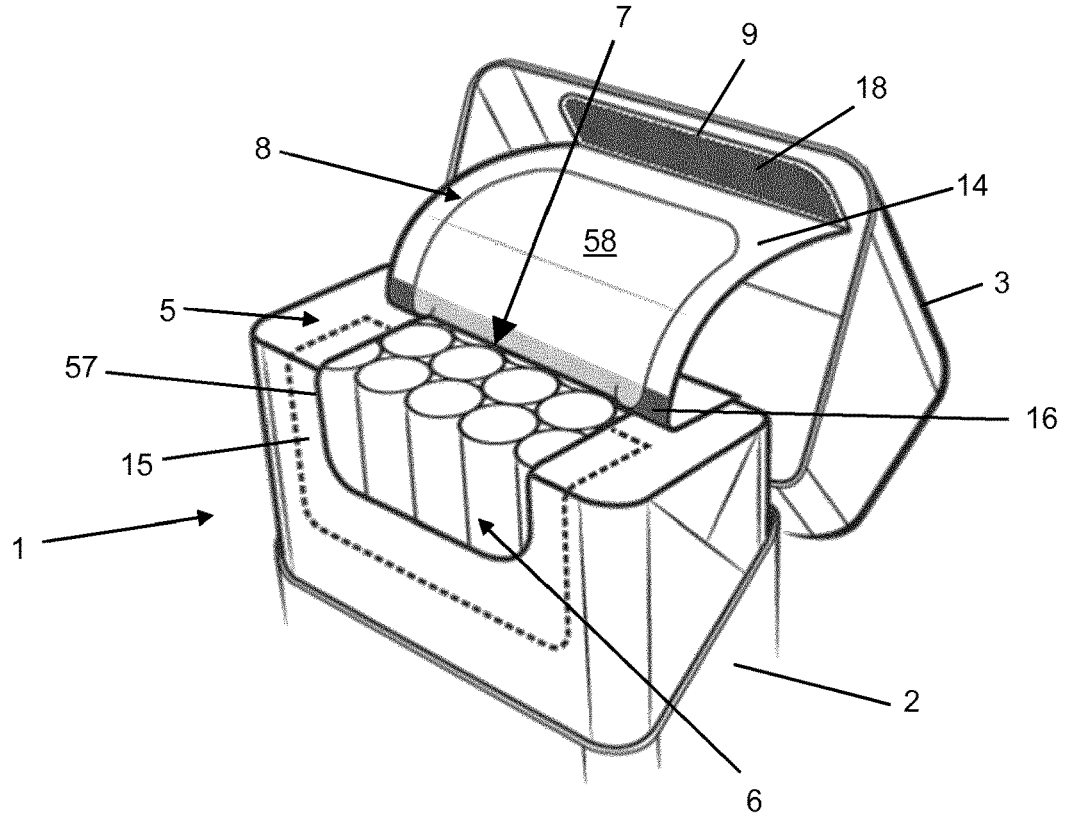
FIG. 6 is a perspective view of an upper part of a container in a fourth embodiment of the invention.
Figure 7:
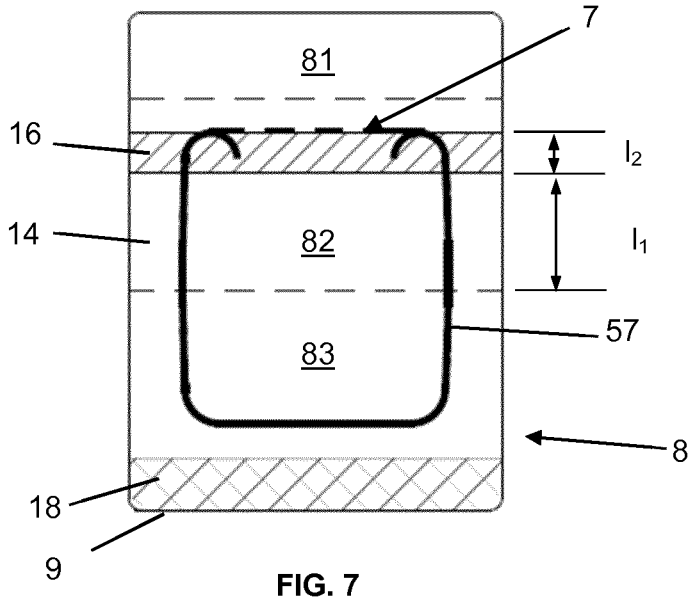
FIG. 7 is a plan view of a reclosable flap of the container in the fourth embodiment of the invention.
Figure 8:
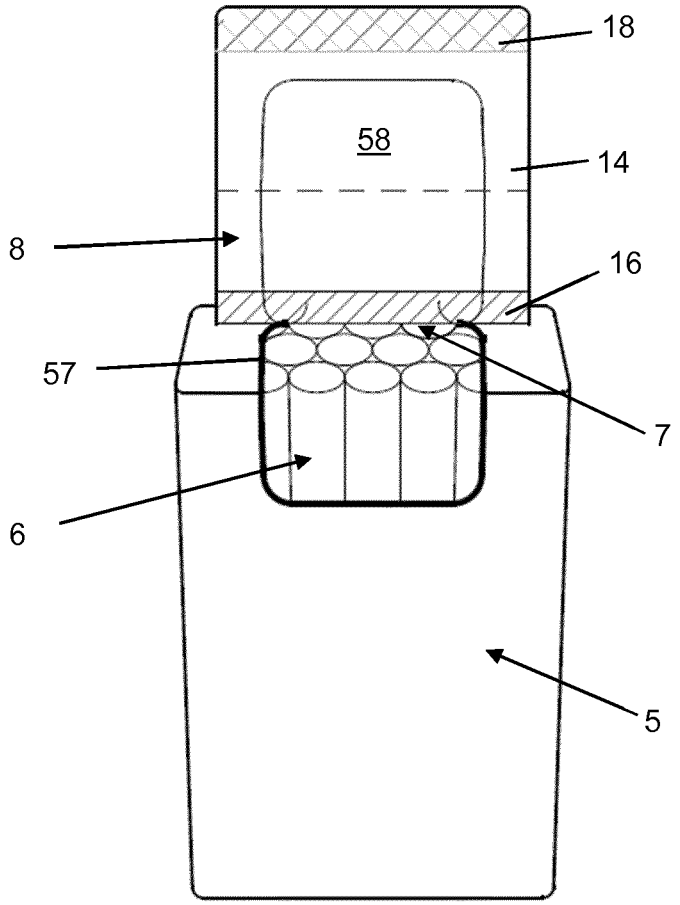
FIG. 8 is a front view of an inner package of the container in the fourth embodiment of the invention.

FIG. 6 is a perspective view of a container 1 in a fourth embodiment of the invention, and FIG. 7 is a plan view of the reclosable flap 8. FIG. 8 is a front view of an inner package 5 for use in the container 1 of this embodiment. The reclosable flap 8 is provided with a first portion 14 having a resealable adhesive, and a second portion 16 which is substantially free of resealable adhesive, and which is adjacent the hinge line 7. The reclosable flap 8 also includes a third portion 18 substantially free of adhesive, which is adjacent the hinged lid 3, specifically at the connecting portion (free end 9) of the label 8. As can be appreciated in FIG. 6, the third portion 18 does not include a portion of the periphery 57 of the access opening 6. Therefore, the resealable adhesive extends about the lower edge of the periphery 57 of the access opening 6, about the left and right edges of the periphery 57 of the access opening 6 in the front wall of the inner package 5 and about a portion of the left and right edges of the periphery 57 of the access opening 6 in the top wall of the inner package 5.

In this arrangement, the reclosable flap 8 advantageously avoids tobacco crumbs from sticking to the flap 8 adjacent the hinge line 7, promotes wide opening of the lid 3, and improves the ease with which the lid 3 opens. Further, the container 1 promotes preservation of tobacco by enabling oxygen exchange between the interior of the inner package 5 and the external environment.

In an alternative embodiment, not shown, the third portion 18 include a lower portion of the periphery 57 of the access opening 6 in a similar embodiment as the second portion 16 of the label 8 of the third embodiment of the invention, represented in FIG. 5. As a result, the resealable adhesive extends about a portion of the left and right edges of the periphery 57 of the access opening 6 in the top wall of the inner package 5, and about a portion of the left and side edges of the periphery 57 of the access opening 6 in the front wall of the inner package 5. The resealable adhesive does not extend about the lower periphery 57 of the access opening 6.

The second portion 16 of the reclosable flap 8 has been described as being substantially free of resealable adhesive. However, at least some of the advantageous effects described herein may be realised by providing the second portion 16 with a reduced adhesiveness, in comparison to the first portion 14.

Figure 9:
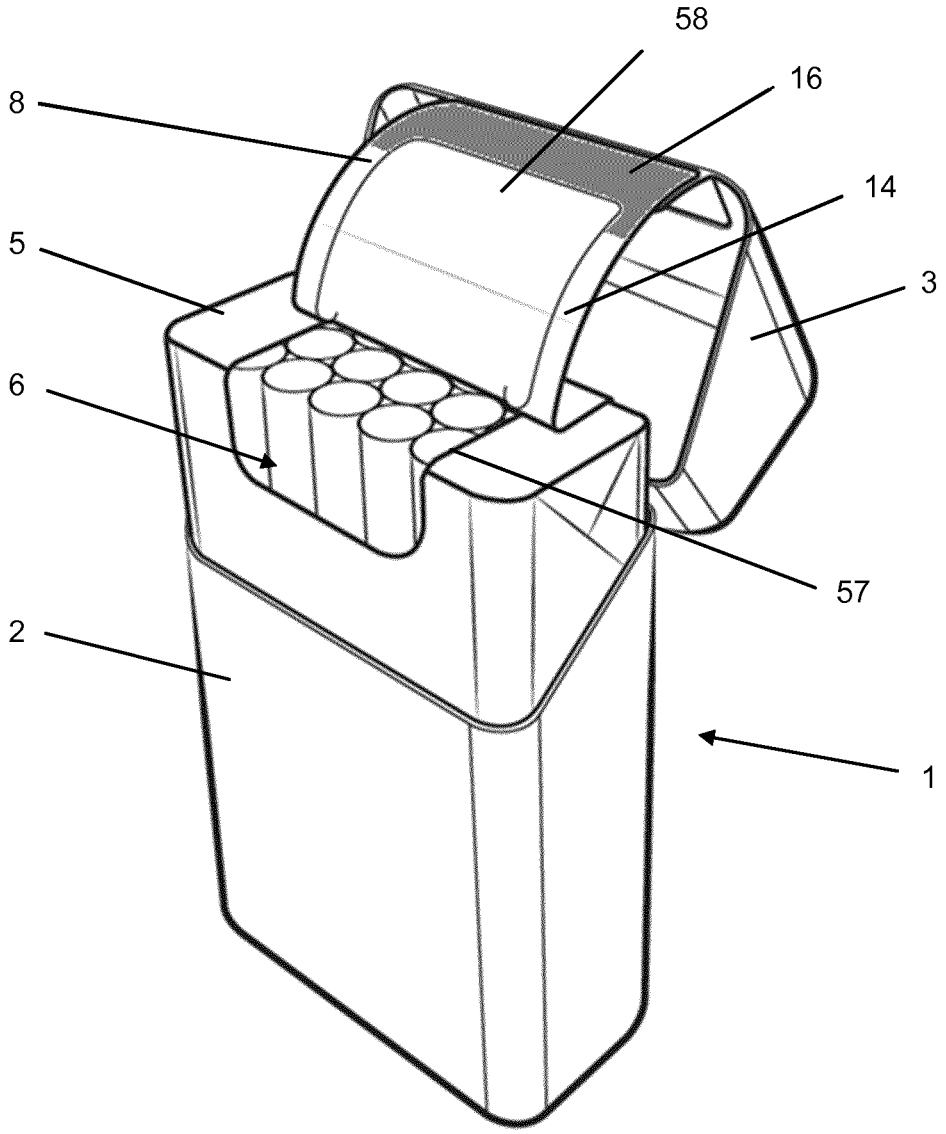
FIG. 9 shows a perspective view of a container in a fifth embodiment of the present invention in a lid open position.
Figure 10:
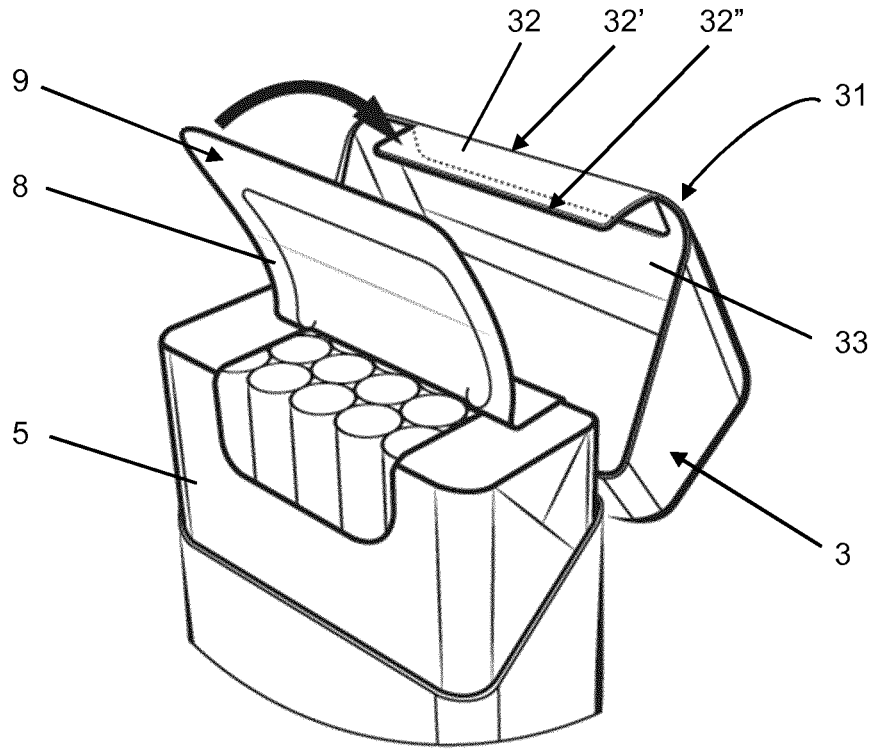
FIG. 10 shows a detail of the container of FIG. 9.

FIG. 9 is a perspective view of another embodiment of a hinged lid container 1. As shown in FIG. 10, the lid front wall comprises a lid outer front panel 31 and two lid inner front panels 32, 33 connected to the lid outer front panel 31 by a crease line. A first lid inner front panel 32 is connected to the lid outer front panel 31 only by the crease line, which defines a rotation axis 32' about which the first lid inner front panel 32 may rotate relative to the lid outer front panel 31. The first lid inner front panel 32 is, thus, rotatable about the lower front edge of the lid 3 relative to the lid outer front panel 31. A second lid inner front panel 33 is connected to the lid outer front panel 31 by the crease line and by permanent adhesive so that the lid outer front panel 31 and the second lid inner front panel 33 do not move relatively.

The outer surface of the label 8 is permanently affixed at its free end 9 to the first lid inner front panel 32, for example with a permanent adhesive, such as a hot melt adhesive or a strip of adhesive carried by a carrier material. As a result, movement of the lid 3 causes movement of the label 8 and of the first lid inner front panel 32, which rotates relatively to the lid outer front panel 31.

In this arrangement, the second portion 16 of the reclosable flap 8, which is substantially free of resealable adhesive, is provided at the free end 9 of the label 8 and around part of the periphery 57 of the access opening 6, similarly to the third embodiment of the invention. The first portion 14 of the reclosable flap 8, which is provided with resealable adhesive, extends from the second portion 16 to the hinge line 7. As can be appreciated in FIG. 9, the resealable adhesive extends about the left and side edges of the periphery 57 of the access opening 6 in the top wall of the inner package 5, about a portion of the left and side edges of the periphery 57 of the access opening 6 in the front wall of the inner package 5, but does not extend about the lower periphery 57 of the access opening 6. Of course, any other embodiment of the reclosable flap 8 that has been previously presented may be used instead of the reclosable flap 8 represented in FIG. 9.

In order to access the cigarettes within the inner package 5, the hinge lid 3 is moved from the closed position to the open position shown in FIG. 9. As the lid 3 is moved from the closed position, an edge 32" of the first lid inner front wall 32 is brought into pivotal contact with the outer surface of the inner package 5. This causes the first lid inner front wall 32 to pivot about the edge 32" from an initial position in which the first lid inner front wall 32 is substantially parallel to the lid outer front wall 31 to a position in which the first lid inner front wall 32 is approximately perpendicular to the lid outer front wall 31, as can be appreciated in FIG. 11. Further rotation of the hinge lid 3 peels off the label 8 from the inner package 5, thereby uncovering the access opening 6 in the inner package 5 through which one or more cigarettes can be removed.

Therefore, the container 1 of the present embodiment provides a two-stage opening of the lid 3. In a first stage, the free end 9 of the reclosable flap or label 8 is pivoted about the inner package 5. In a second stage, the reclosable flap or label 8 is peeled off the inner package 5, thereby uncovering the access opening 6 in the inner package 5. In the first stage, the reclosable flap or label 8 preferably does not even partially uncover the access opening 6.

In order to close the container 1, the hinge lid 3 is moved from the open position to the closed position. As the lid 3 is moved from the open position, the label 8 is rolled over the inner package 5, thereby covering the access opening 6 in the inner package 5. The first lid inner front panel 32 extends the label 8 reach in the open position and tensions the label 8 during lid closing, thereby ensuring the precise repositioning of the adhesive label 8 against the inner package 5. The edge 32" of the first lid inner front wall 32 comes into contact with the inner package 5 at a stop motion position shown in FIG. 11. Further rotation of the hinge lid 3 causes the first lid inner front wall 32 to pivot about the edge 32" from an initial position in which the first lid inner front wall 32 is approximately perpendicular to the lid outer front wall 31 to a position in which the first lid inner front wall 32 is substantially parallel to the lid outer front wall 31, thereby closing the container 1.

Therefore, the container 1 of the present embodiment provides a two-stage closing of the lid 3. In a first stage, the reclosable flap or label 8 is rolled over the inner package 5, thereby covering the access opening 6 in the inner package 5. In a second stage, the free end 9 of the reclosable flap or label 8 is pivoted about the inner package 5.

Figure 11:
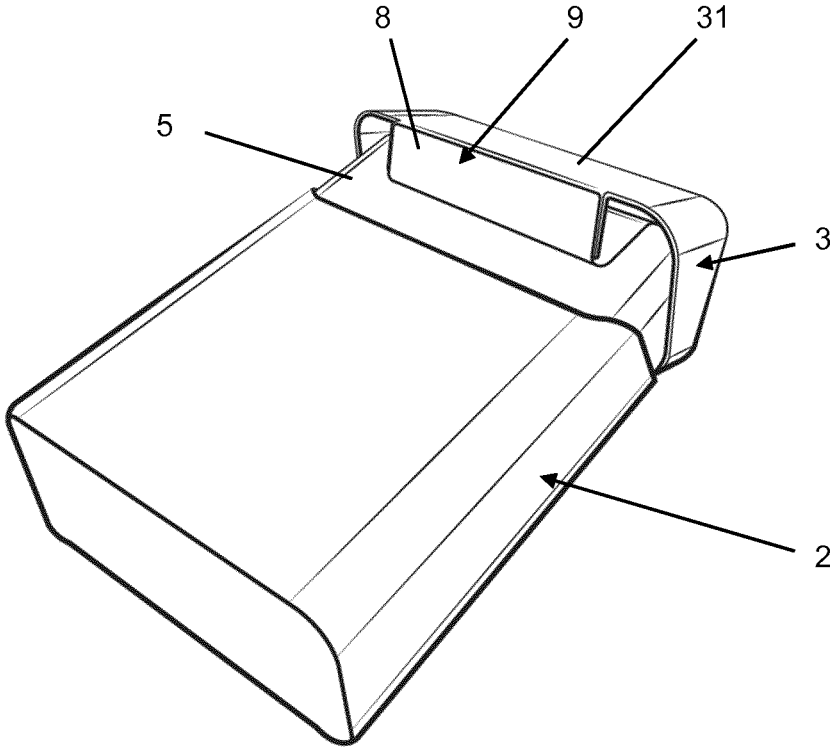
FIG. 11 shows the container of FIG. 9 with the lid in an intermediate position.

The lid 3 is therefore movable about the box 2 between open and closed positions through an intermediate, stable position shown in FIG. 11. Movement of the lid 3 between the closed position and the intermediate position, or vice versa, requires overcoming a biasing force, which may be generated by cooperation of the reclosable flap 8 and a movable lid panel, the first lid inner front panel 32 in this embodiment.

Figure 12:
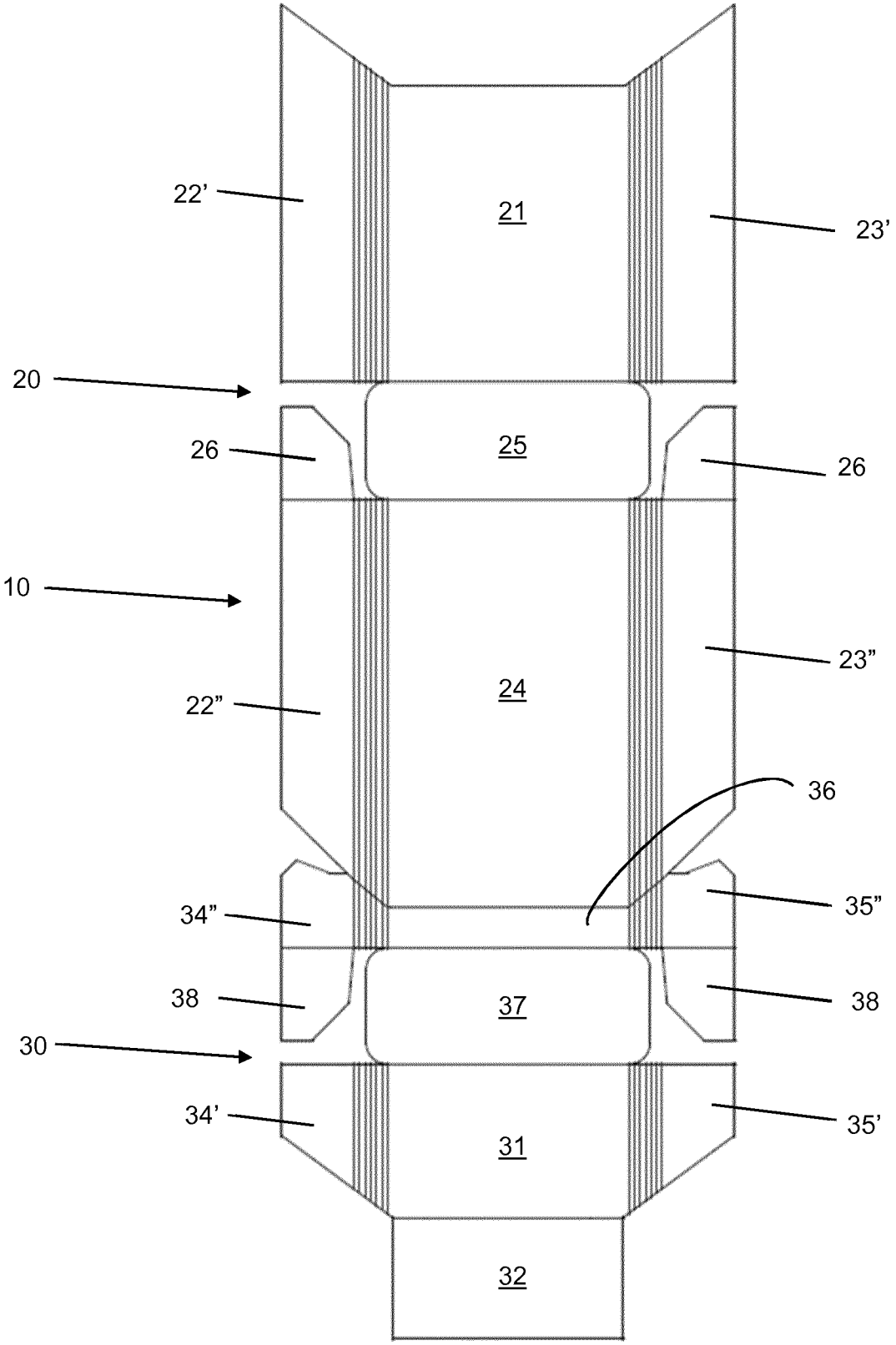
FIG. 12 shows an embodiment of a blank for forming an outer housing of the container in the first to fourth embodiments of the present invention.

FIG. 12 shows a blank 10 for forming the outer housing 1 represented in FIGS. 1, 3, 5 and 6. The blank 10 is divided into two blank portions, a box portion 20 and a lid portion 30. Each blank portion comprises a plurality of panels in which each individual panel is connected to at least another panel, for example, by a crease or fold line.

The box portion 20 comprises a box front panel 21, box outer and inner left side panels 22', 22", box outer and inner right side panels 23', 23", a box back panel 24, a box bottom panel 25 and two box-gluing flaps 26. Although in FIG. 12 the connections of the box front panel 21 and the box back panel 24 to the box outer and inner left and right side panels 23', 23", 24', 24" are shown as a plurality of parallel longitudinal crease lines, these connections could equally be made by single longitudinal crease lines. The remaining panel connections are single transverse crease lines.

In order to assemble the box 2 of the outer housing 1, the box-gluing flaps 26 are glued to the box bottom panel 25 to form the box bottom wall. To form the box left side wall, the box inner left side panel 22" is glued to the box outer left side panel 22'. The box inner right side panel 23" is glued to the box outer right side panel 23' to form the box right wall.

The lid portion 30 comprises a lid outer front panel 31, a lid inner front panel 32, lid outer and inner left side panels 34', 34", lid outer and inner right side panels 35', 35", a lid back panel 36, a lid top panel 37 and two lid-gluing flaps 38. The lid back panel 36 is hingedly connected (e.g. by a crease line) to box back panel 24.

Although the connections of the lid outer front panel 31 and the lid back panel 36 to the lid outer and inner left and right side panels 34', 34", 35', 35" are shown as a plurality of parallel longitudinal crease lines, single longitudinal crease lines could equally make these connections. The remaining panel connections are single transverse crease lines.

To form the lid 3, the lid inner front panel is folded 180° with respect to the lid outer front panel 31 and are glued together. The lid-gluing flaps 38 are glued to the lid top panel 37 to form the lid top wall. The lid left side wall is formed by gluing the lid inner left side panel 34" to the lid outer side panel 34'. Finally, the lid inner right side panel 35" is glued to the lid outer right side panel 35'.

Figure 13:
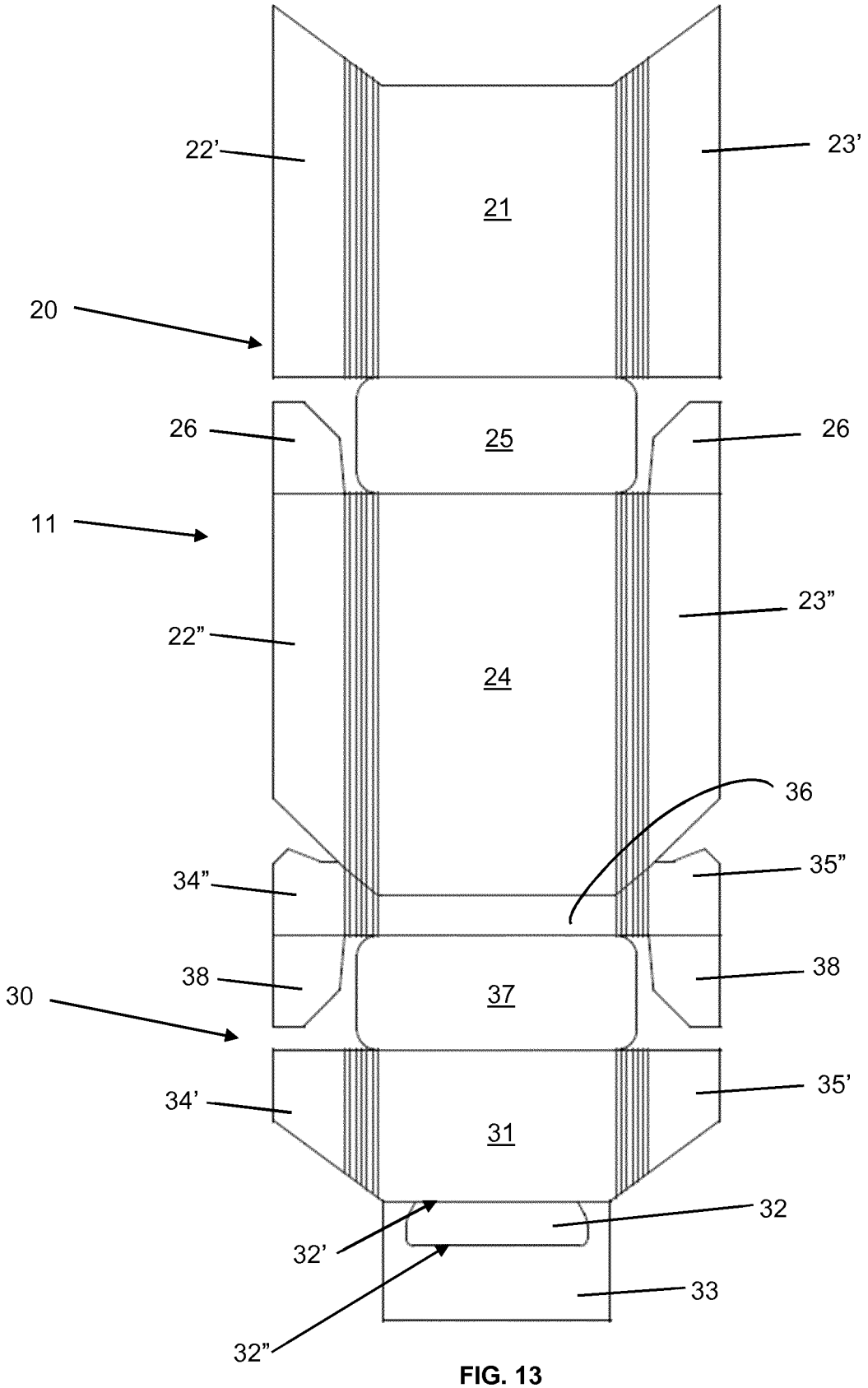
FIG. 13 shows an embodiment of a blank for forming an outer housing of the container in the fifth embodiment of the present invention.

FIG. 13 shows a blank 11 for forming the outer housing 1 represented in FIGS. 9 to 11. For the sake of brevity, only differences between the blanks will be explained below and the same numbering used for the blank 10 shown in FIG. 12 will be used to refer to similar elements.

The blank 11 differs from the blank 10 shown in FIG. 12 in that the lid portion 30 two lid inner front panels 32, 33, which are connected to the lid outer front panel 31 as the first lid inner front panel 32 is surrounded by the second lid inner front panel 33.

Although not shown in FIG. 13, the first and second lid inner front panels 32, 33 may be connected by one or more breakable connections. These one or more breakable connections may be provided along at least one of the edges of the first lid inner front panel 32 that are not connected to the lid outer front panel 31, preferably, at least along an edge 32", which is opposite the edge 32' of the first lid inner front panel 32 that is connected to the lid outer front panel 31.

When forming the lid 3, both lid inner front panels are folded 180° with respect to the lid outer front panel 31 so that they contact, but only the lid outer front panel 31 and the second lid inner front panel 33 are glued together.

Preferably, an adhesive-free region is defined around the periphery of the first lid inner front panel 32 to prevent adhesive trickling into the first lid inner front panel 32. The average width of the adhesive-free region may be of at least 1 mm, for example of about 2 mm.

Figure 14:
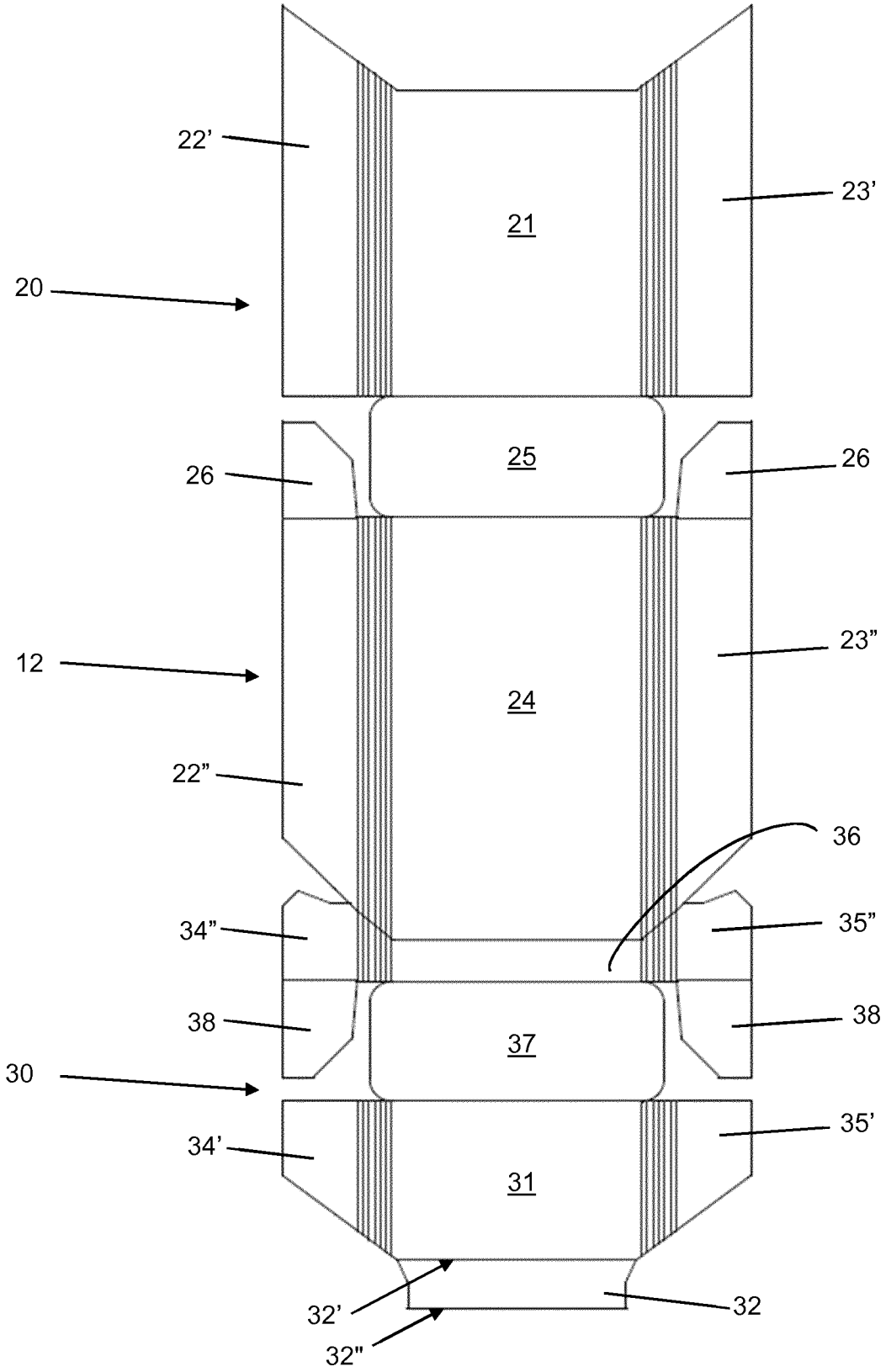
FIGS. 14 and 15 show, respectively, second and third embodiments of a blank for forming an outer housing of the container in the fifth embodiment of the present invention.
Figure 15:
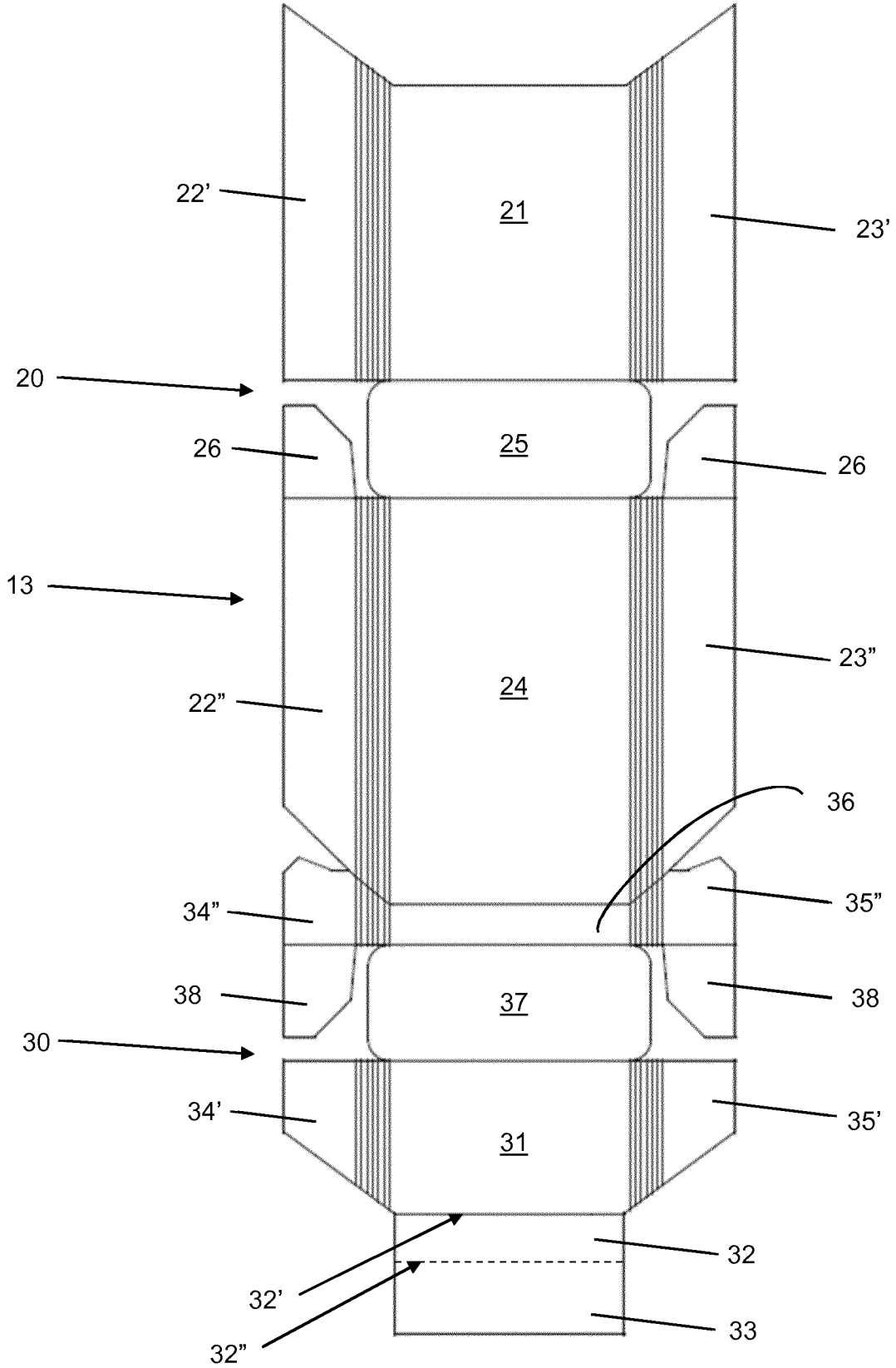

FIGS. 14 and 15 show alternative blanks 12, 13 for forming an outer housing 1 similar to the one represented in FIGS. 9 to 11. For the sake of brevity, only differences between the blanks will be explained below and the same numbering used for the blank 11 will be used to refer to similar elements.

The blank 12 shown in FIG. 14 differs from the blank 11 shown in FIG. 13 in that the lid portion 30 has only one lid inner front panel 32. When the lid 3 is formed, the lid inner front panel 32 is folded 180° with respect to the lid outer front panel 31 so that they contact, but no glue is applied to adhere those two panels.

The blank 13 shown in FIG. 15 differs from the blank 11 shown in FIG. 13 in that the first lid inner front panel 32 is connected at one edge 32' to the lid outer front panel 30 by a crease or fold line and to the second lid inner front panel 33 at another, opposite edge 32" by a line of weakness, such as a row of perforations. The line of weakness 32" may be formed during a step of forming the outer housing 1, preferably before any panels of the blank 12 are folded, for example with a rotary scoring tool.

When the lid 3 is formed, the first lid inner front panel 32 is folded 180° with respect to the lid outer front panel 31 so as to contact. As the second lid inner front panel 33 is connected to the first lid inner front panel 32, by folding the first lid inner front panel 32 with respect to the lid outer front panel 31, the second lid inner front panel 33 and the lid outer front panel 31 also contact. These latter panels are adhered together.

Preferably, an adhesive-free region is defined around the periphery of the first lid inner front panel 32 to prevent adhesive trickling into the first lid inner front panel 32. The average width of the adhesive-free region may be of at least 1 mm, for example of about 2 mm.

When the reclosable flap 8 is affixed to the first lid inner front panel 32 and the container 1 is opened for the first time, the opening force breaks the line of weakness 32" that connects the first and second lid inner front panels 32, 33, thereby mobilizing the first lid inner front panel 32, which becomes rotatable about the crease line 32' that connects it to the lid outer front panel 31. The second lid inner front panel 33 remains attached to the lid outer front panel 31.

Figure 16A:
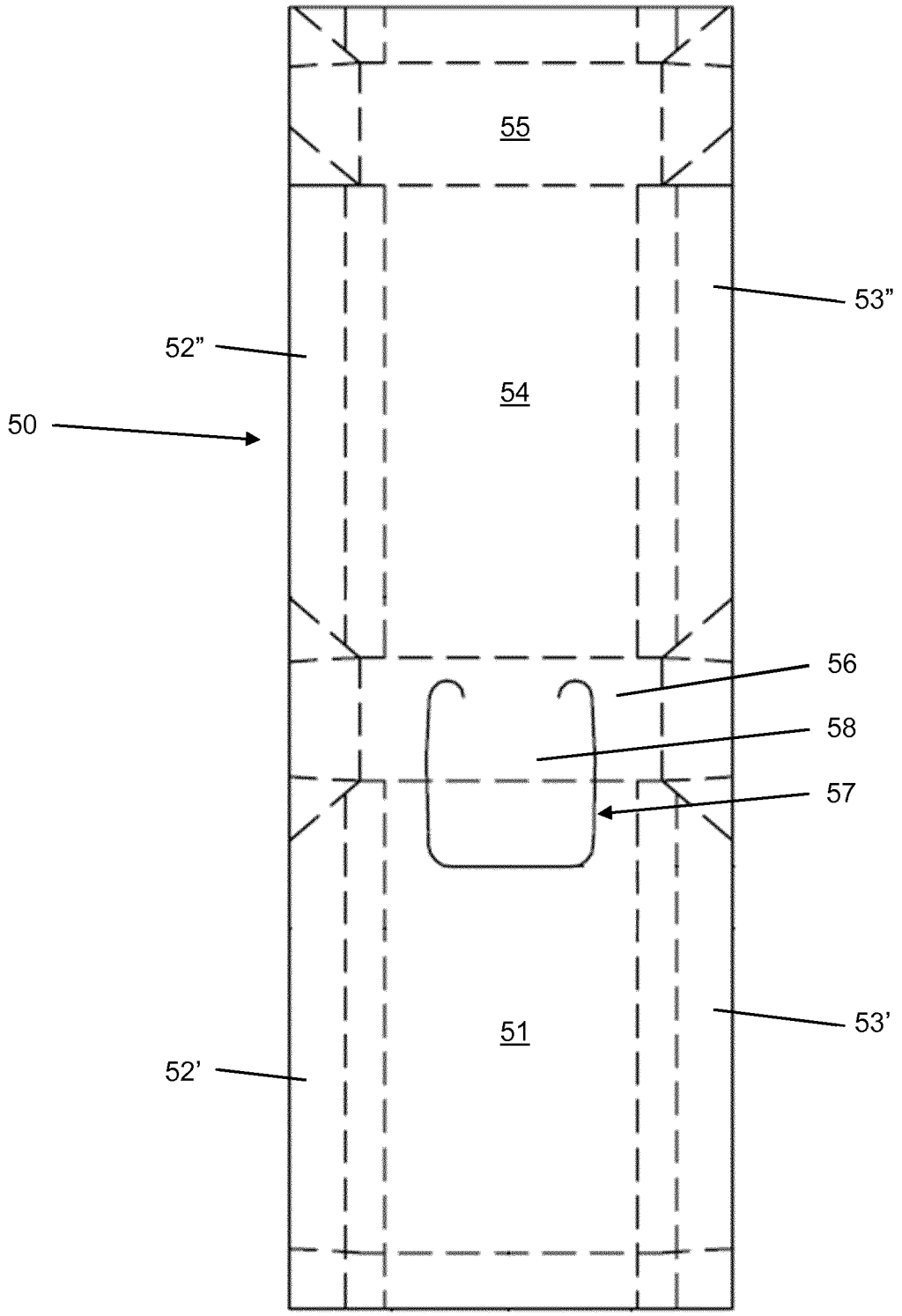
FIGS. 16A and 16B show two different embodiments of a blank for forming an inner package of the present invention.
Figure 16B:
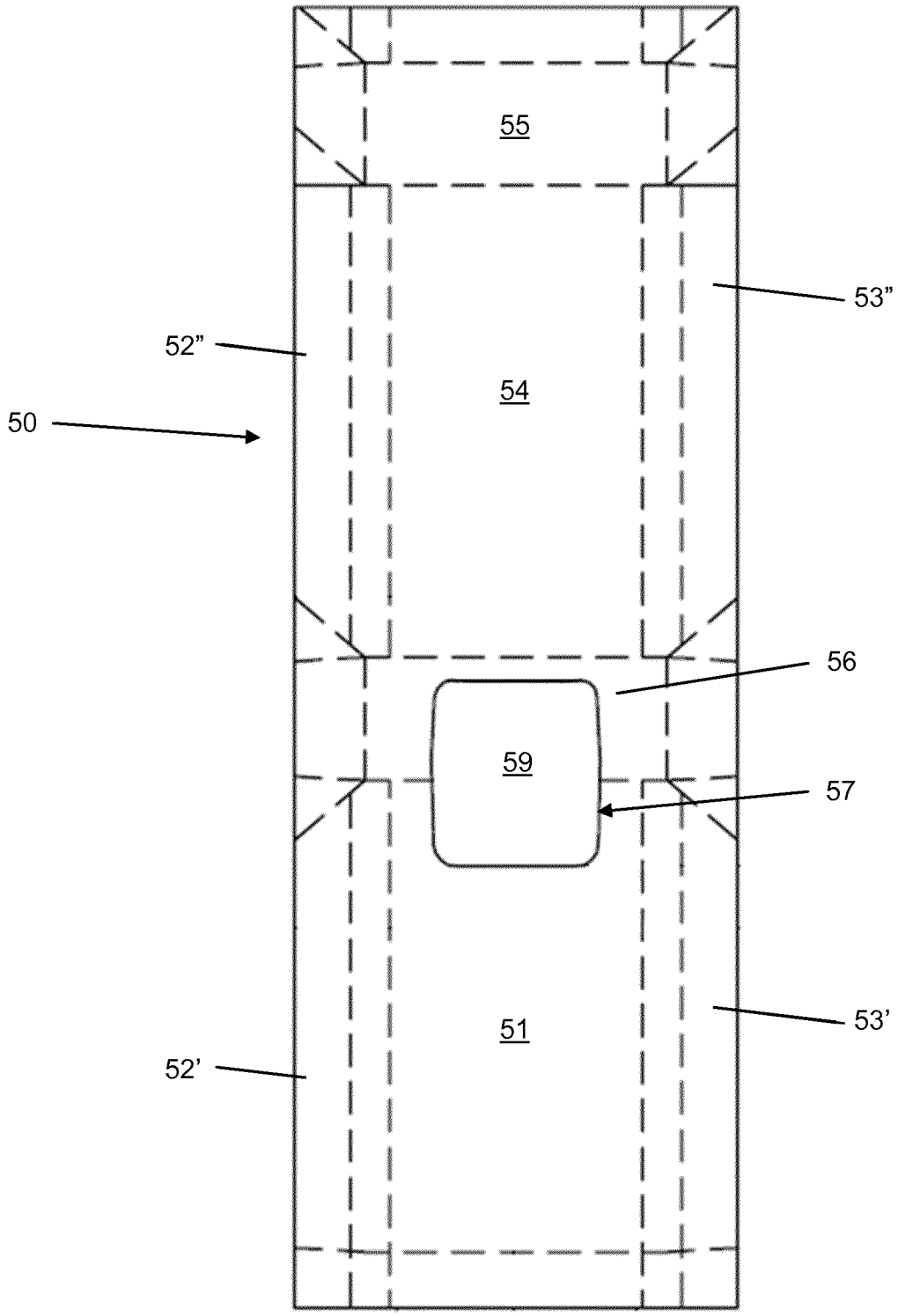

FIGS. 16A and 16B show two alternative blanks for forming the inner package 5 represented in FIGS. 1 to 11. The inner package blanks 50 are made from a substantially rectangular sheet of wrapping material that is folded along the longitudinal and transverse dashed lines represented in FIGS. 16A and 16B.

The inner package blank 50 comprises an inner package front panel 51, inner package outer and inner left side panels 52', 52", inner package outer and inner right side panels 53', 53", an inner package back panel 54, an inner package bottom panel 55 and an inner package top panel 56. Although in FIGS. 15A and 15B the separation of the inner package front panel 51 and the inner package back panel 54 from the inner package outer and inner left and right side panels 53', 53", 54', 54" is shown each as two parallel longitudinal fold lines, this separation could equally be made by a single longitudinal fold line.

The inner package blank 50 represented in FIG. 16A includes a cut line 57 that defines a flap 58. A line of weakness may be provided instead of the cut line so that the flap 58 separates from the inner package 5 only upon first opening of the container 1. In the inner package blank 50 represented in FIG. 16B, the cut line 57 defines a cut-out 59.

To form an inner package 5 from any of the blanks 50 represented in FIGS. 16A and 16B, the inner package outer and inner left side panels 52', 52" are connected (e.g. by glue application or heat-sealing) to each other to form the inner package outer left wall. The inner package right wall is formed by connecting the inner package outer and inner right side panels 53', 53".

Figure 17:
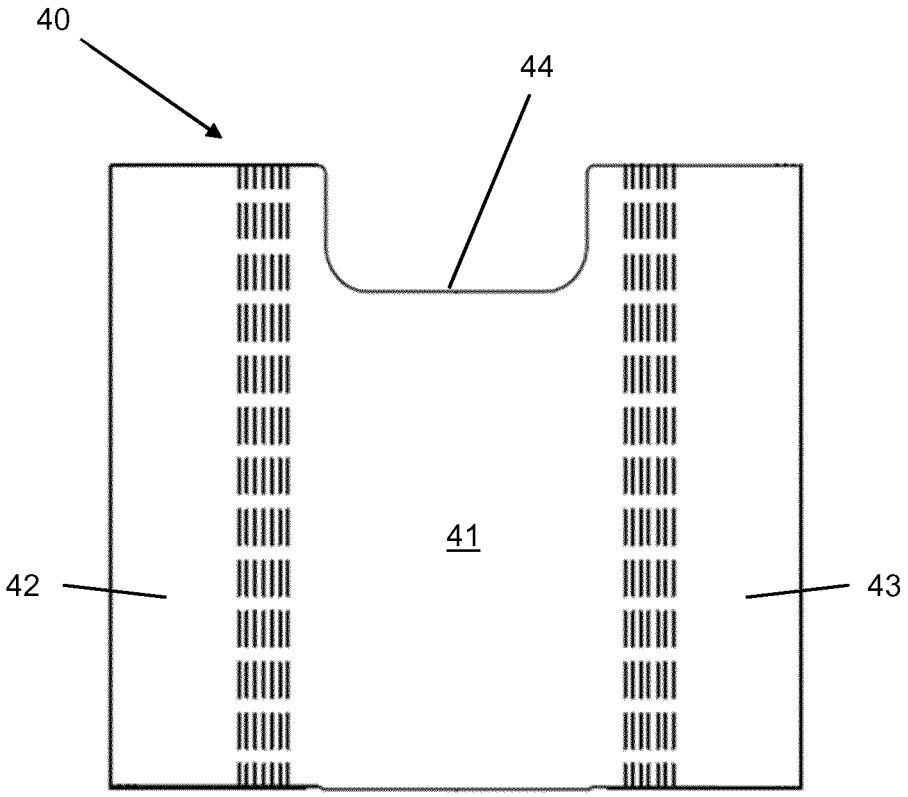
FIG. 17 shows an embodiment of a blank for forming an inner frame of the present invention.

FIG. 17 shows a blank 40 for forming the inner frame housed in the inner package 5 of FIGS. 1 to 11. The inner frame blank 40 comprises an inner frame front panel 41, an inner frame left side panel 42 and an inner frame right side panel 43. Although in FIG. 17 the connections of the inner frame front panel 41 to the inner frame left and right side panels 42, 43 are shown as a plurality of parallel longitudinal crease lines, these connections could equally be made by single longitudinal crease lines.

The inner frame front panel 41 includes a rectangular cut-out 44 at the top free edge, in order to facilitate removal of the cigarettes from the box 2 when the inner frame is assembled from the blank 40. The rectangular cut-out 44 substantially corresponds to a front wall portion of the access opening 6 in the inner package 5. Accordingly, in the third embodiment of the invention, the cut-out is curved shaped to substantially match the curved shaped lower periphery of the access opening 6 in the inner package 5.

To form the inner frame, the inner frame left and right side panels 42, 43 are folded approximately 90° with respect to the inner frame front panel 41. In the assembled condition, the inner frame front panel 41 corresponds to the inner frame front wall, and the inner frame left and right side panels 42, 43 correspond, respectively, to the inner frame left and right side walls.

Figure 18:
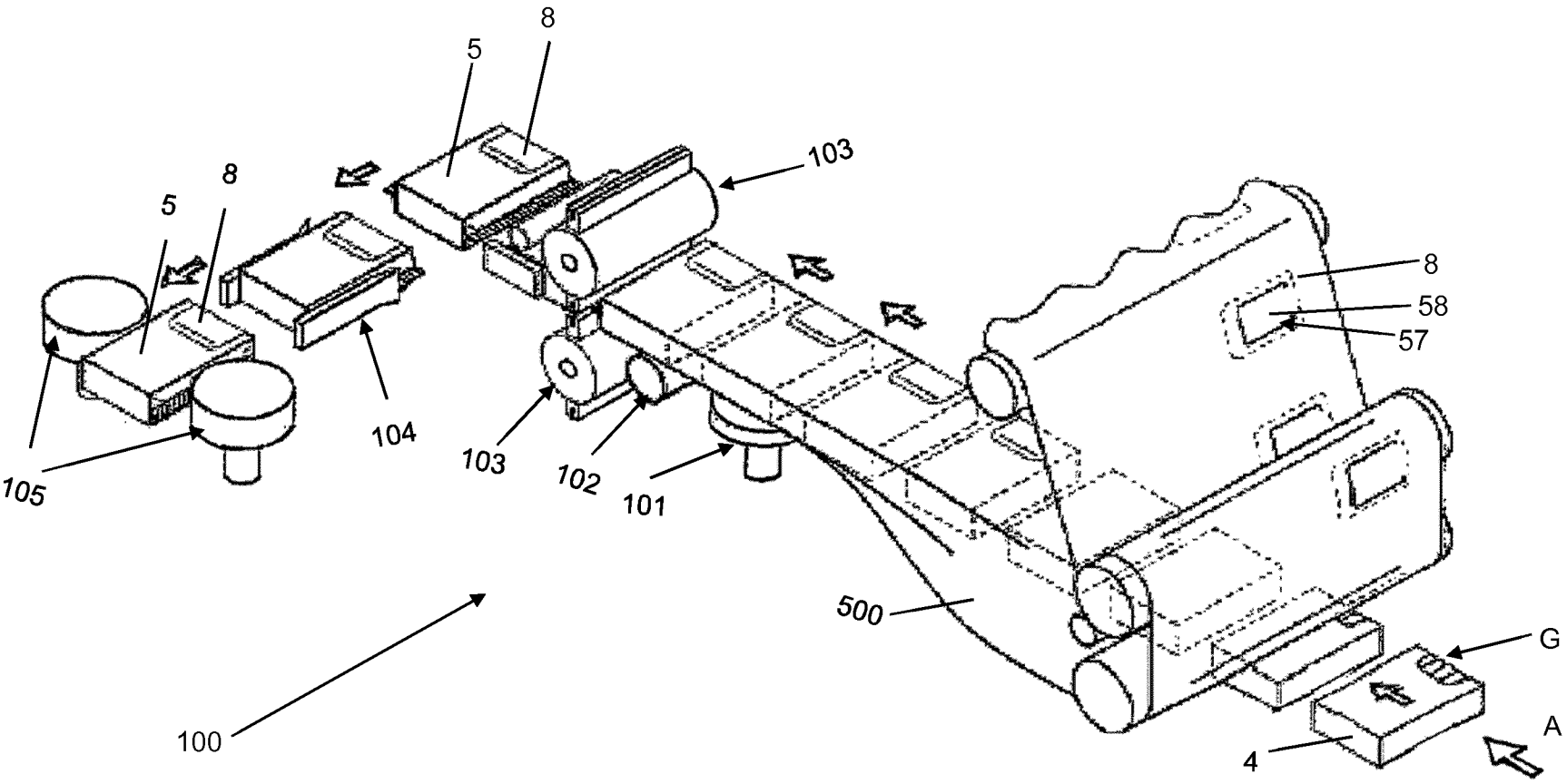
FIG. 18 shows a system for forming an inner package of the present invention.

FIG. 18 shows a system or apparatus 100 for forming an inner package 5 housing smoking articles, such as cigarettes or the like, according to one embodiment of this invention. A series of inner frames 4, each of which is respectively combined with a charge of cigarettes, is transported in direction of arrow A along a packaging path by apparatus 100. The framed charged cigarettes G are conveyed under a continuous sheet of wrapping material 500 (e.g. a metallised plastics laminate film) which is fed from a supply roll (not shown). The wrapping sheet 500 has pre-formed reclosable flaps 8 for alignment with the respective access apertures 44 in the inner frame front panel 41 of each inner frame 4 transported under the wrapping sheet 500.

Rollers 101 arranged below the serially progressing inner frames 4 draw the wrapping sheet 500 tautly over the front and back faces of the framed charge of cigarettes G and against opposite ends of the framed charge of cigarettes G, thereby wrapping the same to form inner package front, top, back and bottom walls. The rollers 101 then cooperate with a sealing head 102 to fuse or seal the drawn wrapping sheet 500 to form a transverse seam at the inner package back wall (not shown). A further elongate sealing head 103 (or pair thereof) following the rollers 101 then operate(s) to clamp and fuse a lateral seam (e.g. as a "fin seal") in the barrier sheet 500 between each of the framed charge of cigarettes G to form the inner package left and right side walls. Trimmers 104 and rollers 105 may then trim and flatten the seams 13, 14 to complete the individual inner packages 5.

A set of blanks for forming the outer housing 1 according to any of the embodiments represented in FIGS. 12 to 15 are folded and glued about the inner package 5 to form the box 2 and lid 3, as previously explained. A permanent adhesive is applied at the outer surface of the reclosable flap 8, particularly at its free edge 9, to connect the reclosable flap 8 to the lid inner front panel 32. As a result, a container for consumer goods according to the invention is formed.

To pre-form the reclosable flaps 8 in the wrapping sheet 500, the access opening 6 is first cut into the wrapping sheet 500 to define a flap 58 (FIG. 16A) or a cut-out 59 (FIG. 16B) and next the reclosable flap 8 is positioned on the wrapping sheet 500 over the access opening 6. The reclosable flap 8 is positioned with respect to the access opening 6 such that the non-adhering region includes a pre-defined portion of the periphery 57 of the access opening 6. This may be achieved by referencing the non-adhering region of the overlap region against the access opening 6.

In the embodiments shown in FIGS. 1 to 4 and 6, the pre-defined portion of the periphery 57 of the access opening 6 is adjacent the reclosable flap 8 hinge line 7. In the embodiments shown in FIG. 5 and FIGS. 7 to 11, the hinge line 7 of the reclosable flap 8 is provided at a first side of the access opening 6 and the pre-defined portion of the periphery 57 of the access opening 6 is provided at a second side of the access opening 6, in this case at an opposite side of the access opening 6.

The invention claimed is:

1. A container for consumer goods comprising:

an outer housing comprising a hinged lid rotatable between an open position and a closed position; and an inner package of consumer goods within the outer housing comprising an access opening through which consumer goods can be removed, the access opening being covered by a reclosable flap;

wherein, in the closed position, the reclosable flap forms an overlap region with a surface of the inner package that extends around a periphery of the access opening, the overlap region comprising a first adhering region to releasably affix the surface of the inner package and the reclosable flap, and a first non-adhering region, the first non-adhering region including a portion of the periphery of the access opening.

2. The container of claim 1, wherein the first non-adhering region extends from an edge of the access opening to an exterior edge of the overlap region.

3. The container of claim 1, further comprising means for attaching the reclosable flap to the hinged lid.

4. The container of claim 1, wherein the reclosable flap is connected to the inner package so as to be movable relative to the inner package about a hinge line.

5. The container of claim 4, wherein the hinge line of the reclosable flap is provided at a first side of the access opening, and wherein the first non-adhering region is provided at a second side of the access opening.

6. The container of claim 5, wherein the first non-adhering region is provided adjacent the hinge line.

7. The container of claim 6, wherein the first non-adhering region has a dimension, extending along the reclosable flap and away from the hinge line, that is at least 4 mm.

8. The container of claim 4, wherein the first non-adhering region is provided in a strip that is substantially parallel to the hinge line.

9. The container of claim 1, wherein the inner package has a top wall and a front wall, and wherein the first adhering region is provided at least partially at the top wall and at least partially at the front wall.

10. The container of claim 9, wherein the adhering region has a length, extending along the inner package and away from the front wall along the top wall, which is at least 4 mm.

11. The container of claim 1, wherein the overlap region comprises a second non-adhering region, and wherein the first adhering region is between the first and second non-adhering regions.

12. The container of claim 11, wherein the second non-adhering region includes a portion of the periphery of the access opening.

13. The container of claim 1, wherein the overlap region comprises a second adhering region.

14. A method of manufacturing a container for consumer goods, comprising the steps of:

providing an outer housing comprising a hinged lid rotatable between an open position and a closed position;

providing an inner package of consumer goods within the outer housing, wherein the inner package comprises an access opening through which consumer goods can be removed;

providing a reclosable flap to cover the access opening of the inner package, wherein, in the closed position, the reclosable flap forms an overlap region with a surface of the inner package that extends around a periphery of the access opening;

providing a first adhering region in the overlap region to releasably affix the surface of the inner package and the reclosable flap; and providing a first non-adhering region, the first non-adhering region including a portion of the periphery of the access opening.

15. The method of claim 14, comprising the additional step of:

positioning the reclosable flap on the inner package with respect to the access opening such that the first non-adhering region includes a pre-defined portion of the periphery of the access opening.

* * * * *